United States Patent [19]

Wiens

[11] Patent Number: 4,531,715

[45] Date of Patent: Jul. 30, 1985

[54] WINCH WITH STORABLE HANDLE

[76] Inventor: Ralph W. Wiens, 2021 Dufour Ave., Apartment C, Redondo Beach, Calif. 90278

[21] Appl. No.: 619,268

[22] Filed: Jun. 11, 1984

[51] Int. Cl.[3] ..... B66D 1/00

[52] U.S. Cl. ..... 254/266; 74/547; 254/369; 254/376

[58] Field of Search ..... 242/96; 254/266, 369, 254/376; 74/546, 547; 403/61, 101, 102

[56] References Cited

U.S. PATENT DOCUMENTS

| | | | |
|---|---|---|---|
| 1,059,884 | 4/1913 | Link | 74/547 |
| 1,191,855 | 7/1916 | Tuszka | 403/61 X |
| 2,556,995 | 6/1951 | Coffing | 74/547 |
| 2,913,195 | 11/1959 | Phillips | 74/547 X |
| 3,536,299 | 10/1970 | McCloud et al. | 254/369 |
| 4,057,218 | 11/1977 | Wallace | 254/369 |
| 4,391,432 | 7/1983 | Baud | 254/266 X |

FOREIGN PATENT DOCUMENTS

| | | | |
|---|---|---|---|
| 1003347 | 2/1957 | Fed. Rep. of Germany | 74/547 |
| 527743 | 10/1940 | United Kingdom | 254/369 |
| 1432957 | 4/1976 | United Kingdom | 254/369 |

*Primary Examiner*—Stuart S. Levy

*Assistant Examiner*—Katherine Jaekel

*Attorney, Agent, or Firm*—Robert J. Schaap

[57] ABSTRACT

A winch for the spooling of a flexible cord and having a collapsable and storable handle and which may be used in a variety of applications, as for example, in the in-line pulling of a rope in a sailboat. The winch generally comprises a spool which is mounted on a frame such as a spindle for rotatable movement. A handle or crank arm is axially shiftable and storable within a bore in the spool and is capable of shifting outwardly of the spool for use. The crank arm is mounted through a hinge mechanism which permits the same to be located in a plane essentially perpendicular to the axis of rotation of the spool. A releasable locking means is provided for releasably locking the crank arm to the spool for causing rotation of the same. A hand grip is hingedly mounted on the crank arm and is telescopically shiftable relative to the crank arm. The hand grip is also capable of being located in essentially perpendicular relation to the crank arm and parallel to the axis of rotation of the spool for purposes of rotating the spool. Another locking means is provided for releasably locking the hand grip to the crank arm when the hand grip is perpendicularly disposed relative to the crank arm.

21 Claims, 11 Drawing Figures

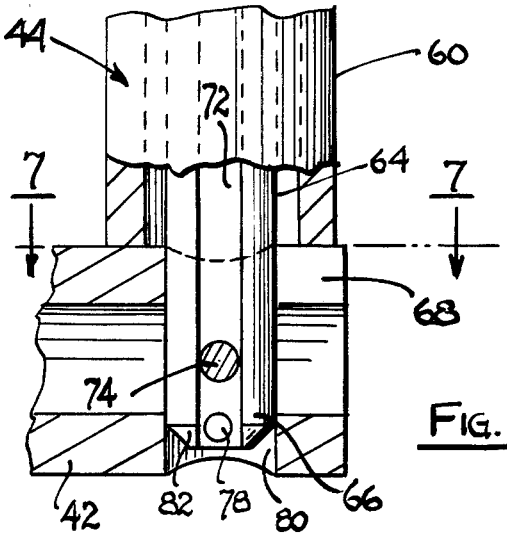
FIG. 6
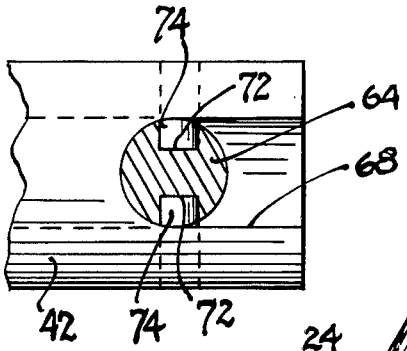
FIG. 7
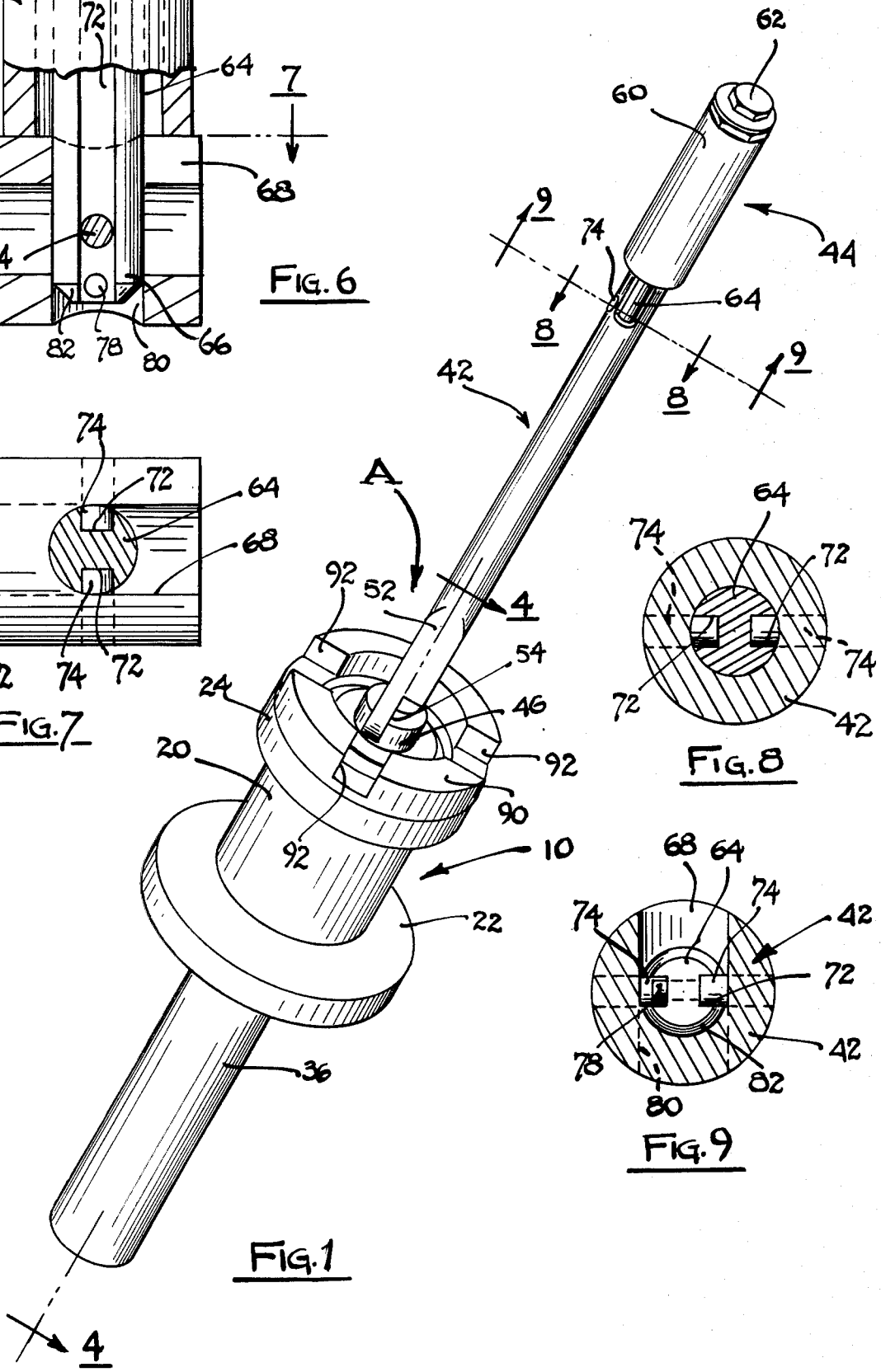
FIG. 1
FIG. 8
FIG. 9

62
44
60
64
72
74
66
42
26
3
24
52
92
56
50
48
46
28
20
10
16
36
40
14
12
22
90
A

WINCH WITH STORABLE HANDLE

BACKGROUND OF THE INVENTION

1. Field of the Invention

This invention relates in general to certain new and useful improvements in winches, and more particularly, to winches which have a rotatable spool and a handle or crank arm capable of being stored within an interior portion of the spool and which is capable of being moved outwardly of the spool and releasably locked with respect to the same in order to permit rotation to thereby enable a pulling of a cord.

2. Brief Description of the Prior Art

Manually operable winches of the type which include a rotatable spool and a crank arm for rotation thereof are used in a variety of applications. One of the common uses of winches of this type is in sailboats for purposes of obtaining a mechanical advantage in the trimming of a sail such as a fore sail.

During the steering of a sailboat, it is necessary to control the position of the fore sail in order to obtain the best wing driving efficiency. Consequently the operator of the sail boat must constantly re-position the fore sail relative to the boat as the boat is being steered. Since the operator must pull the rope connected to the fore sail, often referred to as a "jib sheet" against a substantial wind force, a mechanical advantage is needed. This is particularly true in heavy wind conditions.

When the operator is trimming the sail, there may be an initial amount of slack in the rope and this slack may be wound about the spool of the winch by hand. Since the winch handle may be of substantial length to obtain the desired mechanical advantage, it is necessary to remove the handle when rope is wound about the winch and drawn by hand. Otherwise, the handle would get in the way of the operator who is self winding the initial amount of rope about the winch spool. Further, the rope itself may engage the winch handle and cause an inadvertent separation of the winch handle from the winch. This may cause a resultant loss of the handle by being thrown overboard or at least to a position where it is not immediately available to the operator in the process of trimming a sail.

Winches of this type are also effective for other purposes in sailboats. For example, they may be used in the raising of an anchor or as a type of brake in the case of lowering an anchor.

These winches, when used with sailboats, usually present a bulky and space consuming structure. In addition, since a substantial lever arm is often required to obtain the necessary mechanical advantage, the crank arm must have a length which is also substantial relative to the size of the spool. Since these winches are frequently mounted on a boat deck or side wall of the boat, usually referred to as a "gunwale", the crank arm is obtrusive and usually gets in the way which can oftentimes result in accidents. Accordingly, it is also desirable to remove the winch crank arm when not in use to preclude accidents and injury.

One significant problem with the removeable winch handle is that it can oftentimes be misplaced and lost among myriads of other implements normally found on sailboats. Furthermore, there is usually a substantial amount of movement and physical activity and therefore a tendency for the winch handle to be inadvertently dislodged and perhaps to be inadvertently shoved overboard. Due to the fact that most winch handles are constructed of a heavy metal, they will rapidly sink and accordingly, if the sailboat user does not have an auxiliary winch handle, he may find himself in a difficult position to perform the necessary functions on the sailboat, or more importantly, to even control the sailboat as may be required. U.S. Pat. No. 3,685,761 to Zelinski discloses a fishing reel assembly in which a fishing line or cord is paid out from and spooled upon a fishing reel spool. The support shaft which holds this supply spool is extensible.

U.S. Pat. No. 2,460,216 to Dalton discloses a universal joint in which a handle is capable of being pivoted and is capable of engaging a slot in a socket. U.S. Pat. No. 2,519,536 to Barbagelata discloses a hand tool having a bar which is capable of engaging notches in a hand tool assembly. U.S. Pat. No. 4,368,856 to Neufeld discloses a folding crank handle on a fishing reel.

Heretofore, there has not been any winch which is capable of having a winch handle collapsed and stored in the spool of the winch and removeable therefrom for releasable locking to the winch for rotating same.

OBJECTIONS OF THE INVENTION

It is, therefore, a primary object of the present invention to provide a winch having a spool and a crank arm which is capable of being stored within the spool when not in use.

It is another object of the present invention to provide a winch of the type stated in which the crank arm of the winch is telescopically collapsable with respect to the spool of the winch.

It is a further object of the present invention to provide a winch of the type stated in which a hand grip is pivotally mounted on the crank arm so as to be moved into and located in a plane which is parallel to the axis of rotation of the winch spool.

It is an additional object of the present invention to provide a winch of the type stated which can be manufactured at a relatively low unit cost.

It is still a further object of the present invention to provide a winch of the type stated which is designed for use in and is highly effective for use on sailboats.

With the above and other objects in view, my invention resides in the novel features of form, construction, arrangement and combination of parts presently described and pointed out in the claims.

SUMMARY OF THE INVENTION

A winch for the spooling of a cord or so-called "line" and having a collapsable and storable handle or so-called "crank arm". The winch comprises a frame means, which may be in the nature of a spindle, with a spool operatively mounted for rotation on the frame means.

The spool is preferably provided with a bore or recess for the storage of a crank arm which is used to rotate the spool. The crank arm is elongate and is shiftable outwardly of this bore formed within the spool for purposes of engaging the spool and enabling rotation of the spool. The crank arm is preferably moved axially outwardly of the spool along the axis of rotation of the spool.

A knee-joint or so-called "hinge means" operatively connects the crank arm to the spool such that the crank arm can be angularly disposed with respect to the spool. In a preferred embodiment, the crank arm is capable of being rotated to a position where it is perpendicular to the axis of rotation of the spool.

The winch preferably comprises a locking means for releasably locking the crank arm with respect to the spool for rotating the crank arm and thereby rotating the spool therewith. When the spool is rotated in a certain direction, it will take up and wind the cord about the spool, e.g. for at least a few turns.

In a more preferred embodiment of the invention, a hand grip is pivotally secured to one end of the crank arm. The hand grip is capable of being pivoted to a plane which is generally parallel to the axis of rotation of the spool when the crank arm is located in a plane where it is perpendicular to the axis of rotation of the spool and locked to the spool.

The hand grip is telescopically mounted with respect to the crank arm and the two are capable of being telescopically collapsed relative to one another when the crank arm and hand grip are stored within the bore of the spool. However, when in use, the hand grip is capable of being rotated to a plane where it is perpendicular to the axis of the crank arm and is parallel to the axis of rotation of the spool.

In a more preferred embodiment, the winch comprises a cylindrically shaped spool having an end plate thereon. The locking means comprises at least one notch in the end plate to releasably retain the crank arm. Preferably, the locking means comprises at least one notch and the crank arm is provided with a section to be received and releasably held within the notch. In a more preferred embodiment, the end plate is provided with a plurality of such notches.

In addition, a second releasable locking means is provided to enable the hand grip to be locked in this latter position when in use. A unique joint, often referred to as a "knuckle joint" permits the hand grip to be telescopically shiftable relative to the crank arm and permits the hand grip to be pivotal relative to the axis of the crank arm and also permits the hand grip to be locked to the crank arm by movement perpendicular to the axis of the crank arm.

The term "spooling" or "winding" with reference to the winding of the cord about the spool does not necessarily imply an accumulation of more than a few turns of the cord on the spool. In many cases this winch is used only to obtain a mechanical advantage where only a few turns are wound on the spool and the latter is turned with a long crank arm to obtain the necessary mechanical advantage. In other cases, the spool is sufficiently large to accumulate and retain a large number of turns of the cord. The term "spooling" also does not imply an ability to unwind any turns from the spool by rotation in an opposite direction. Thus, the term "spooling" is used interchangably with "pulling" to represent an in-line pulling of a cord since at least a few turns of the cord are wound about the spool to enable the cord pulling operation.

This invention possesses many other advantages and has other purposes which may be made more clearly apparent from a consideration of forms in which it may be embodied. These forms are shown in the drawings accompanying and forming part of the present specification. They will now be described in detail, for the purposes of illustrating the general principles of the invention; but it is to be understood that such detailed descriptions are not to be taken in a limiting sense.

BRIEF DESCRIPTION OF THE DRAWINGS

Figures 2, 3:
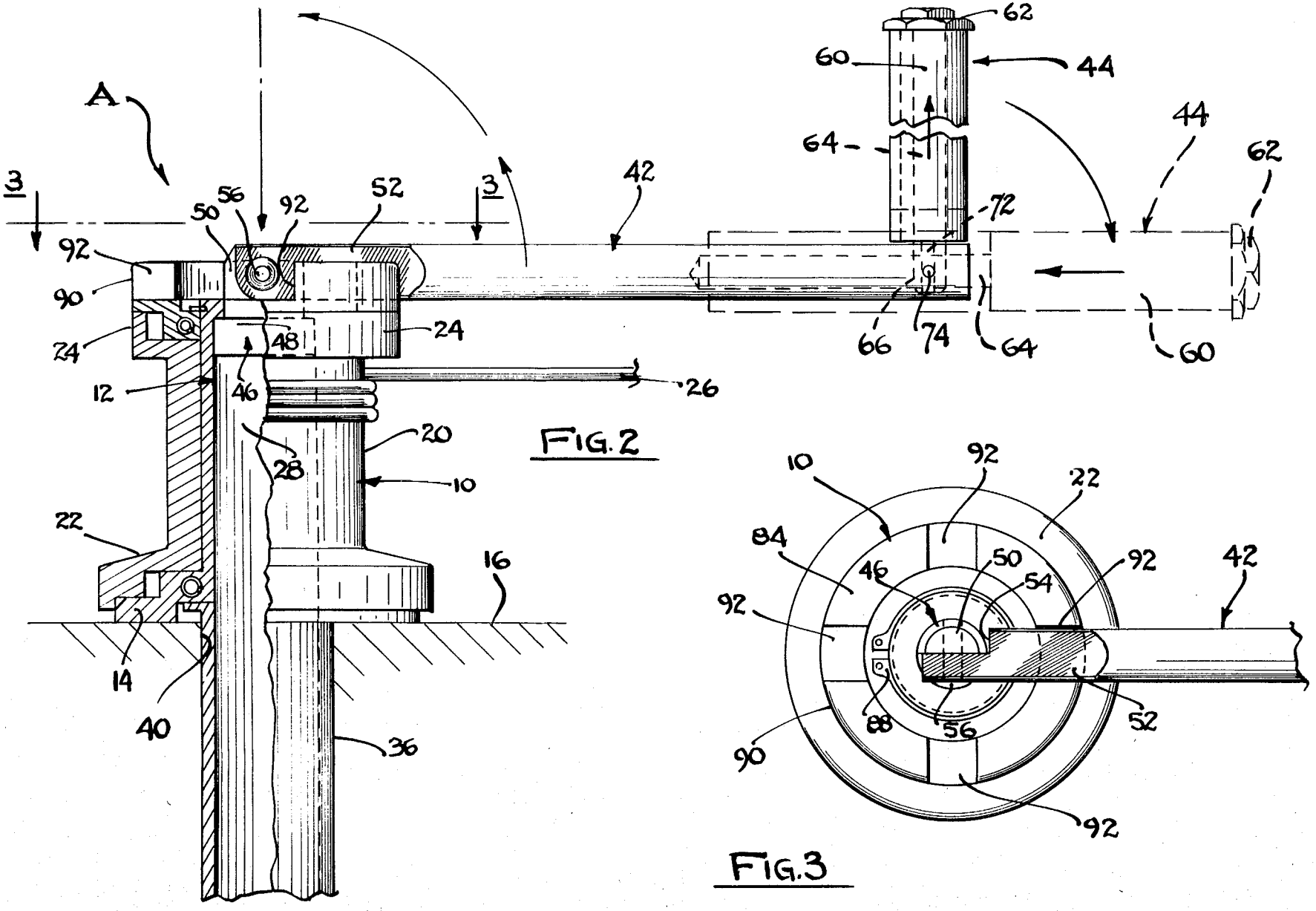
Figures 4, 5, 10, 11:
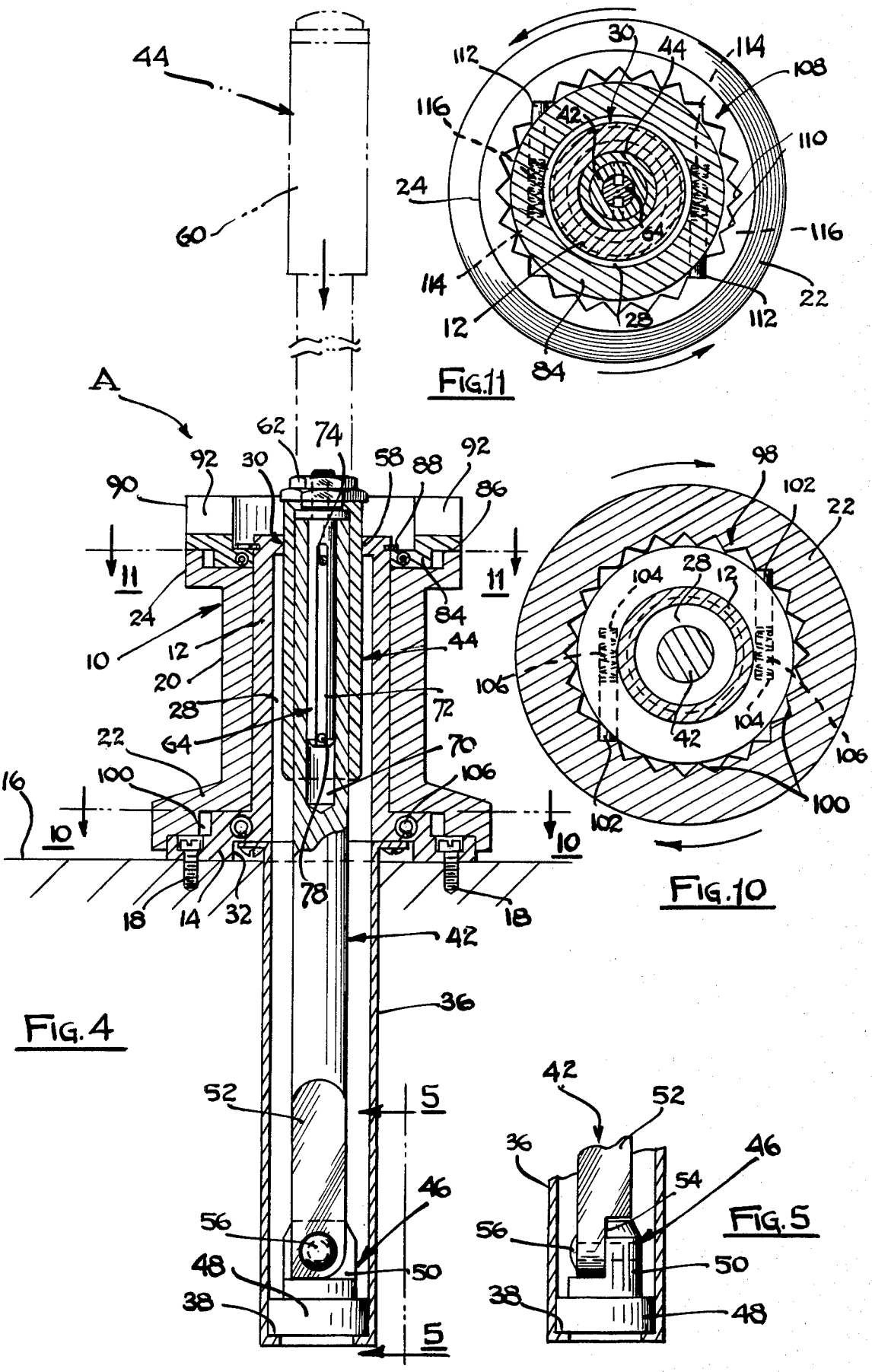

Having thus described the invention in general terms, reference will now be made to the accompanying drawings (three sheets) in which:

FIG. 1 is a perspective view of the winch of the present invention and showing a crank arm and hand grip forming a part thereof in the extended position outwardly from a spool thereof;

FIG. 2 is a side elevational view, partially broken away and in section, and showing the crank arm forming part of the winch in a position where it is locked to the spool of the winch and the hand grip in a position where it is locked to the crank arm;

FIG. 3 is a fragmentary top plan view of the winch taken along a plane of line 3—3 of FIG. 2 and showing the crank arm in a position where it is locked to the spool of the winch;

FIG. 4 is a vertical sectional view taken essentially along line 4—4 of FIG. 1, but showing the crank arm and handle in a position where they are stored within the spool of the winch;

FIG. 5 is a fragmentary vertical sectional view taken essentially along the plane of line 5—5 of FIG. 4 and showing a knee joint connecting the crank arm to a slide in the spool;

FIG. 6 is a vertical sectional view showing the details of construction of the connection between the hand grip and the crank arm;

FIG. 7 is a horizontal sectional view taken along line 7—7 of FIG. 6 and showing further details of construction between the hand grip and crank arm;

FIG. 8 is a sectional view taken along line 8—8 of FIG. 1 and showing a portion of the knuckle joint for retaining the hand grip on the crank arm of the winch of the present invention;

FIG. 9 is a sectional view taken essentially along line 9—9 of FIG. 1 and showing the means for retaining the hand grip against further outward movement with respect to the crank arm;

FIG. 10 is a horizontal sectional view taken along line 10—10 of FIG. 4 and showing the details of construction of a lower ratchet mechanism forming part of the winch of the present invention; and FIG. 11 is a horizontal sectional view taken along line 11—11 of FIG. 4 and showing the details of construction of an upper ratchet mechanism forming part of the winch of the present invention.

DETAILED DESCRIPTION OF A PREFERRED EMBODIMENT

Referring now in more detail and by reference characters to the drawings which illustrate a preferred embodiment of the present invention, A designates a manually operable winch of the type which is capable of being used for a pulling of a cord. While the winch of the present invention finds highly effective use in boating environments, as for example, on sailboats to obtain the necessary mechanical advantage in the trimming of sails, it is also effective in other environments, as for example, in other areas where it is desired to pull a cord against a substantial weight or force, or to merely wind and accumulate a cord. The winch of the present invention is hereinafter described for use, as for example, in sailboats. However, and as indicated, it is to be understood that the winch is not so limited and can find use in a variety of applications.

The winch A of the present invention generally comprises a bell shaped outer housing 10 which functions as a spool and which is rotatably disposed about an inner sleeve 12. By reference to FIG, 4, it can be observed that the sleeve 12 has an integrally formed outwardly extending annular base flange 14 for securement to a boat deck or other supporting surface. In FIG. 4, it can be seen that the base flange 14 is secured to a boat deck 16 by means of screws or other fasteners 18. Furthermore, the means for mounting the entire winch could be a releasable means, if desired so that the winch can be moved and re-secured in a different position. However, these winches are usually permanently mounted in a fixed position.

The winch A of the invention has been illustrated and is described in an orientation where it is vertically disposed inasmuch as it normally would be mounted on a boat deck in such vertical orientation. However, it should be understood that the invention is not limited to this orientation and that the winch could be oriented and mounted so that the central axis of the spool is, for example, horizontally located.

The spool 10 comprises an elongate cylindrically shaped spool sleeve section 20 and an integrally formed diametrically enlarged lower end plate 22 which extends around and generally encloses the base flange 14. The spool 10 also comprises an integrally formed diametrically enlarged upper end plate 24.

A cord or cable 26, which may be in the form of a rope, for example, is wrapped around the spool sleeve section 20 and is shown as being wound around the spool sleeve section 20, in the manner as illustrated in FIG. 2 of the drawings.

The inner sleeve 12 is provided with a cylindrically shaped bore 28 which extends therethrough between the outwardly presented face of the base flange 14 and an upper radially inwardly projecting end flange 30 which partially closes the bore 28. Secured to the underside of the base flange 14 of the inner sleeve 12 in a recessed area 32 thereof, by means of machine screws 34, is a downwardly extending receiving tube 36, as best seen in FIGS. 2 and 4. The receiving tube 36 is also provided with a bottom in-turned flange 38 which may be integrally formed therewith. The boat deck or other receiving member 16 is drilled or otherwise provided with a hole 40 for the receiving tube 36 to extend downwardly below the boat deck.

The bore 28 and the tube 36 are aligned and have a common cross-sectional size and shape to receive a crank arm 42. The crank arm and a hand grip 44 on the outer end thereof are adapted to be fully collapsed and stored in the bore 28 and tube 36 when not in use, as shown in solid lines in FIG. 4. However, the crank arm 42 and hand grip 44 may be pulled outwardly therefrom, in the manner as illustrated in FIG. 1, and as hereinafter described in more detail. The combination of an elongate winch crank arm and a hand grip thereon is often referred to as a "winch handle".

Vertically shiftably disposed within the bore 28 and in the tube 36 is a slide 46 which has a T-shaped cross-section. The slide 46 is provided with an enlarged disc-like base portion 48 and an upwardly projecting hub 50 which is adapted for pivotal connection to the inner end of the crank arm 42. It can be observed that the crank arm 42, which is more fully illustrated in FIGS. 2 and 4, has a rectangularly shaped lower end 52 for reasons which will presently more fully appear. Furthermore, the lower end 52 of this crank arm 42 has a milled region forming a recess 54 for mounting to the hub 50 of the slide 46 by means of a pivot pin 56, in the manner as more fully illustrated in FIGS. 2–5 of the drawings. If desired, the lower end 52 of the crank arm 42 could be provided with a bifuricated portion for mounting to the hub 50 of the slide 46. This construction is in the nature of a knee joint and serves as a first hinge means or hinge member.

It can be observed, by reference to FIGS. 3 and 4 of the drawings, that the slide 46 is capable of shifting from the lower end of the tube 36 adjacent the flange 38 to the opposite end of the spool adjacent the upper end flange 30. The upper end flange 30 is provided with a central aperture 58 to accommodate the hand grip 44 and crank arm 42. However, due to the size of the aperture 58, the slide 46 cannot be shifted outwardly of the bore 28 which limits the uppermost movement thereof.

The hand grip 44, as shown in FIG. 4, is also comprised of an elongate cylindrically shaped, tubular, hand section housing 60 which is extendable outwardly from the upper end of the crank arm 42. A jam nut assembly 62, is secured against the outer end of the hand grip housing 60 and permits rotational clearance for the hand grip 44, and a bolt 64 which extends axially through the hand grip housing 60. The bolt 64 has a lower end 66 which is pivotally secured within a slot 68 in the upper outer end of the crank arm 42, as hereinafter described in more detail.

The crank arm 42 is provided with a bore 70 to receive the bolt 64 as hereinafter described. The bolt 64 is provided with a pair of longitudinally extending spaced apart slots 72 on opposite sides thereof to slidably receive guide pins 74 fixedly retained by and which extend into the bore 70 of the crank arm 42. These guide pins 74 enable the bolt, and hence the hand grip, to be telescopically slidable relative to the crank arm 42 and also enable a pivotal connection of the hand grip 44 to the upper end of the crank arm 42. This construction is more fully illustrated in FIGS. 6–8 of the drawings. This pivotal connection between the crank arm 42 and hand grip 44 constitutes and forms part of a knuckle joint, hereinafter described in more detail.

The hand grip 44 is telescopically shiftable over the upper end of the crank arm 42 in the manner as shown in FIG. 4, where the crank arm and hand grip are stored in the bore 28 and tube 36. Further, the hand grip is capable of being telescopically shifted outwardly therefrom to the position as shown in phantom lines in FIG. 2 and solid lines in FIG. 1. In addition, the hand grip 44 is pivotal with respect to the crank arm 42 so that the two are in perpendicular arrangement as shown in solid lines in FIG. 2.

The bore 70 of the crank arm receives the bolt 64, as aforesaid, when the hand grip 44 is telescopically collapsed and concentrically located over the crank arm 42. Thus, this construction, which functions as a knuckle joint or second hinge means, enables the telescopic shifting movement of the hand grip relative to the crank arm for telescopic collapsing during storage and extension and pivoted movement for use. An additional pin 78 which functions as a retaining pin is fixedly mounted in the bolt 64 and is moveable therewith. When the hand grip 44 is extended outwardly relative to the crank arm, as shown in FIG. 1, the retaining pin 78 will abut against one of the guide pins 74 thereby limiting the outermost movement of the hand grip 44 and preventing separation of the hand grip 44 from the crank arm 42.

The crank arm 42 is also provided with a bolt receiving aperture 80 adjacent its outer end, as more fully illustrated in FIG. 6, and which forms part of a hand grip locking means. When the hand grip 44 is pulled outwardly, first to a position in alignment with the crank arm, as shown in the phantom lines of FIG. 2, and then pivoted to be perpendicular to the crank arm 42, as shown in the solid lines of FIG. 2, there is no immediate locking action. When the hand grip is pushed downwardly (inwardly) in a direction perpendicular to the axis of the crank arm 42, the bolt end 66 will extend into the aperture 80, as shown in FIG. 6, and provide a position locking action. For this purpose, the bolt 64 is provided with a beveled lower end 82.

This construction of the knuckle joint is unique and highly effective in that it permits a telescopical movement of the hand grip axially relative to the outer end of the crank arm. It also permits a pivotal movement of the hand grip relative to the crank arm so that it is angularly disposed (perpendicularly disposed) to the axis of the crank arm. The knuckle joint construction further permits a locking movement of the hand grip in the angularly disposed (perpendicularly disposed) position relative to the crank arm so that the hand grip is releasably locked to the crank arm. This locking action is obtained merely by moving the hand grip perpendicular to the axis of the crank arm in one direction to achieve a positive locking action and in the opposite direction to release this locking action.

In accordance with the above defined construction, it can be observed that when it is desired to store the hand grip 44 and crank arm 42, when not in use, the crank arm is merely inserted into the bore 28 of the spool 10 and into the receiving tube 36 by pushing against the same and forcing the slide 46 to the lower end flange 38. The hand grip 44 is also telescopically disposed over the crank arm 42 upper end when the crank arm is stored. When it is desired to use the winch, the crank arm 42 is pulled outwardly to the position as shown in FIG. 1. At this point, the crank arm is capable of being pivoted about the pivot pin 56 to the position as shown in FIG. 2. Finally, the hand grip 44 is moved to the position shown in the solid lines of FIG. 2 and locked to the crank arm 42.

Fitted on the upper end of the bell housing 10 is an upper disc or plate 84 having an outwardly extending offset flange 86. A locking ring 88 engages an annular notch in the sleeve 12 and overlays a portion of the plate 84 to hold the latter in position so that the upper plate 84 is rotatable with the spool 10 and independently of the spool 10, for reasons which will presently more fully appear.

The flange 86 of the upper plate 84 is integrally provided with an upstanding rim section 90 which is provided with a plurality of circumferentially spaced apart generally rectangularly shaped notches 92 and which are sized to receive the lower end 52 of the crank arm 42. Thus, when the rectangularly shaped lower end 52 is fitted within any one of the notches 92, a rotation of the crank arm 42 will cause a rotation of the upper plate 84 and hence the entire spool 10. However, the crank arm can only rotate the spool in one direction, the clockwise direction, as shown in FIG. 10, and as hereinafter described in more detail.

Located between the outwardly extending lower end plate 22 of the bell housing 10 which forms part of the spool and the base of the bell housing 10 which forms part of the spool and the base flange 14 is a first ratchet mechanism 98, which is more fully illustrated in FIGS. 4 and 10 of the drawings. This ratchet mechanism 98 comprises a plurality of teeth 100 on the lower end plate 22 of the bell housing 10 and which are arranged to be engaged by ratcheting pawls or pins 102 extending outwardly from the base flange 14. The ratcheting pins 102 are fitted within bores 104 drilled into the base flange 14 and are biased outwardly into the teeth by means of compression springs 106. Furthermore, the teeth 100 are somewhat pyramid shaped and the pins 102 are so located so as to permit ratcheting and rotation in only one direction relative to the lower end plate 22 of the spool 10, reference being made to FIG. 10, namely, the clockwise direction.

A second and upper ratchet mechanism 108 is located between the disc 84 and the upper portion of the bell housing 10, as shown in FIGS. 4 and 11 of the drawings. This second ratchet mechanism 108 locks the upper plate 84 to the bell housing in only one direction, reference being made to FIG. 11, namely the clockwise direction. It will only ratchet with respect to and not rotate the bell housing 10 in the opposite direction, as for example, rotation in the counterclockwise direction. The upper ratchet mechanism 108 comprises a plurality of teeth 110 on the interior portion of the upper end of the bell housing 10 and which are engageable by a pair of ratcheting pins 112 located in bores 114 formed in the upper end of the inner sleeve 12. The ratcheting pins 112 are fitted within these bores 114 which are also drilled into the sleeve 12 and are biased outwardly against the teeth 110 by means of compression springs 116 in the manner as shown.

Thus, when the crank handle is positioned in the manner as illustrated in FIG. 2, e.g. releasably locked to the spool, it will cause rotation of the entire spool in one direction, as for example, the clockwise direction, reference being made to FIG. 11. However, when rotated in the opposite direction, it will only rotate the upper plate 84, but will not rotate the spool itself. In this way, rotation of the crank arm can only cause rotation of the spool in one direction.

This hand grip 44 is pivotally mounted through the second hinge means to the crank arm, as aforesaid. In this way, the hand grip 44 can be positioned as shown in solid lines in FIG. 4 for storage. It can also be positioned as shown in FIG. 2 for use. When this occurs, the entire crank arm is in a position where its axis is generally perpendicular to the axis of rotation of the spool 10. Moreover, the hand grip 44 would then be in a position where it is perpendicularly located with respect to the axis of the crank arm 42 and parallel to the axis of rotation of the spool 10. In this position, the crank arm is effectively in a position for rotating the spool and spooling of the cord or cable.

Thus there has been illustrated and described a unique and novel winch in which a handle forming part of the winch is storable within the spool of the winch and which thereby fullfils all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described my invention, what I desire to claim and secure by Letters Patent is:

1. A winch for pulling a cord and having a crank arm which is storable in the winch, said winch comprising:
(a) frame means,
(b) a spool mounted on said frame means for rotatable movement, said spool having a bore therein,
(c) a crank arm axially shiftable outwardly of the bore of said spool for use and axially into said bore of said spool for storage,
(d) a hinge means enabling said crank arm to shift to a plane angularly located with respect to the axis of said spool so that a portion extends generally radially to the axis of said spool,
(e) first locking means for releasably locking said crank arm with respect to said spool for rotating said crank arm and the spool therewith,
(f) a hand grip pivotally mounted on an end of said crank arm,
(g) a knuckle joint pivotally connecting said hand grip to said crank arm so that said hand grip is movable from a position where it is generally axially aligned with the crank arm to a position where it is angularly disposed relative to the axis of said crank arm,
(h) second locking means forming part of said knuckle joint and releasably locking said hand grip to said crank arm when the hand grip is angularly located with respect to the axis of said crank arm, and
(i) means associated with said knuckle joint to permit telescopic movement between said crank arm and said hand grip and which also permits rotatable movement of said hand grip on said crank arm, said knuckle joint and said last named means cooperating to enable said hand grip to be movable from a position where it is almost completely disposed over and encircles and surrounds an outer end of said crank arm and is axially aligned with said crank arm to a position where it is located axially outwardly with respect to said crank arm and is not encircling and telescopically disposed over and surrounding the outer end of said crank arm.

2. The winch of claim 1 further characterized in that said hinge means enables said crank arm to be located in a plane generally perpendicular to the axis of rotation of said spool.

3. The winch of claim 2 further characterized in that said hand engageable grip is operatively connected to said arm by said knuckle joint which enables said hand grip to extend outwardly from said arm and to be located in a direction and plane generally parallel of the axis of rotation of said spool.

4. The winch of claim 2 further characterized in that said spool is tubular and a slide is located to be axially shiftable in said bore and which hinge means is operative with said slide for enabling said crank arm to telescopically extend into said spool for storage when not in use and pulled outwardly from said spool for use.

5. The winch of claim 1 further characterized in that said first locking means releasably locks said crank arm to said spool.

6. The winch of claim 5 further characterized in that said spool comprises a cylindrically shaped spool with an end plate thereon, said first locking means comprising at least one notch in said end plate to receive and releasably retain said crank arm.

7. The winch of claim 6 further characterized in that said first locking means comprises at least one generally rectangularly shaped notch in said end plate and said crank arm has a section of generally rectangular cross sectional shape which is sized to be received and releasably retained in said notch.

8. The winch of claim 6 further characterized in that said end plate comprises a plurality of said notches.

9. The winch of claim 1 further characterized in that said winch is used on and is provided with means for mounting to a rigid structure on a sail boat.

10. The winch of claim 1 further characterized in that said hand grip is pivotally mounted on said crank arm and is pivotally moved from a position where it is general axially aligned with the crank arm to a position where it is perpendicularly disposed relative to the axis of said crank arm, and said second locking means locks said hand grip to said crank arm when the hand grip in perpendicularly located with respect to the axis of said crank arm.

11. The winch of claim 1 further characterized in that the means which forms part of said knuckle joint to permit telescopic movement of said hand grip with respect to said crank arm is an elongate rod which extends through said hand grip, and said knuckle comprises a pivot pin which operatively connects said rod of said hand grip to an outer end of said crank arm and permits hinged movement of said hand grip.

12. The winch of claim 11 further characterized in that said releasble locking means locks said hand grip when the latter is pushed inwardly perpendicularly with respect to the axis of said crank arm and is released when pulled outwardly perpendicularly with respect to the axis of said crank arm.

13. An assembly of a winch arm and hand grip wherein the hand grip is telescopically shiftable and pivotal relative to the crank arm; said assembly comprising:
(a) an elongate crank arm,
(b) a hand grip pivotally connected to an end of said crank arm,
(c) a knuckle joint pivotally connecting said hand grip to an outer end of said crank arm, said knuckle joint also comprising a pivot means to permit pivotal movement of said hand grip from a first position relative to said crank arm where it is generally axially aligned with said crank arm to a second position where it is angularly disposed with respect to said crank arm,
(d) restraining means associated with said knuckle joint for preventing said hand grip from being separated from said crank arm,
(e) releasable locking means operatively associated with and forming part of said knuckle joint permitting said hand grip to be releasably locked to said crank arm in the angularly disposed position, said releasable locking means comprising an elongate rod which permits said hand grip to be, locked when pushed axially toward the crank arm when in the angularly disposed position and unlocked when the hand grip is pulled axially relative to the axis of the crank arm
(f) means telescopically retaining said hand grip on said crank arm so that said hand grip is movable axially from a position where it is almost completely disposed over and encircles and surrounds an outer end of said crank arm when axially aligned with said crank arm to a position where it is not encircling and telescopically disposed over and covering an outer end of said crank arm.

14. The winch of claim 13 further characterized in that said releasable locking means locks said hand grip to said crank arm when said hand grip is pushed inwardly perpendicularly with respect to the axis of said crank arm and is released when pulled outwardly perpendicularly with respect to the axis of said crank arm.

15. A winch for pulling a cord and having a crank arm which is storable in the winch, said winch comprising:

(a) frame means, (b) a spool mounted on said frame means for rotatable movement, said spool having a bore therein, (c) a crank arm axially shiftable outwardly of the bore of said spool for use and axially into said bore of said spool for storage and which crank arm has an outer end, (d) hinge means enabling said crank arm to shift to a plane angularly located with respect to the axis of said spool so that a portion extends generally radially to the axis of said spool, (e) locking means releasably locking said crank arm with respect to said spool for rotating said crank arm and the spool therewith, (f) a hollow cylindrically shaped hand grip telescopically mounted on the outer end of said crank arm and which is telescopically slideable with respect to the crank arm and is also pivotal on the outer end of said crank arm, (g) an elongate rod located within and extending coaxially within said hollow hand grip and which rod has an elongate longitudinally extending guide slot therein, said hand grip being movable axially with respect to said rod from a position where it is almost completely disposed over and encircles and surrounds an outer end of said crank arm and is axially aligned with said crank arm to a position where it is moved axially outwardly of said crank arm and is not encircling and telescopically disposed over said crank arm, (h) a stopping pin operatively retained by said crank arm at the outer end thereof and which permits movement of said rod and hand grip during relative movement between said stopping pin and elongate guide slot, and (i) abutment pins radially mounted on an inner wall of said crank arm and being engageable by said stopping pin to control the limit of movement of said hand grip.

16. The winch of claim 15 further characterized in that said crank arm is pivotal to a plane where it is generally perpendicular to the axis of rotation of said spool after being moved axially outwardly with respect to said crank arm.

17. A winch for pulling of a cord, said winch comprising:

(a) frame means, (b) a spool mounted on said frame means for rotatable movement, said spool having a bore therein, (c) an elongate crank arm telescopically extendable outwardly of said bore along the axis of rotation of said spool, (d) hinge means enabling said crank arm to be moved and located in a direction where it is angularly located with respect to the axis of rotation, (e) locking means for releasably locking said crank arm with respect to said spool for rotating the spool and crank arm therewith, (f) a hand grip pivotally connected to an end of said crank arm, (g) a knuckle joint pivotally connecting said hand grip to an outer end of said crank arm, said knuckle joint comprising a pivot means to permit pivotal movement of said hand grip from a first position relative to said crank arm where it is generally axially aligned with said crank arm to a second position where it is angularly disposed with respect to said crank arm, (h) restraining means associated with said knuckle joint for preventing said hand grip from being separated from said crank arm, (i) releasable locking means operatively associated with and forming part of said knuckle joint permitting said hand grip to be releasably locked to said crank arm in the angularly disposed position, and (j) means associated with said knuckle joint to enable telescopic movement of said hand grip with respect to said crank arm, so that the hand grip can be telescopically moved from a position where it is almost completely disposed over and encircles and surrounds an outer end of said crank arm to a position where it is not encircling and telescopically disposed over said crank arm and which also permits rotatable movement of said hand grip on said crank arm.

18. The winch of claim 17 further characterized in that said releasable locking means locks said hand grip to said crank arm when said hand grip is pushed inwardly perpendicularly with respect to the axis of said crank arm and is released when pulled outwardly perpendicularly with respect to the axis of said crank arm.

19. A winch for pulling a cord having a crank arm which is storable in the winch, said winch comprising:

(a) frames means, (b) a spool mounted on said frame means for rotatable movement, said spool having a bore therein, (c) a crank arm axially shiftable outwardly of the bore of said spool for use and axially into said bore of said spool for storage and which crank arm has an outer end, (d) hinge means enabling said crank arm to shift to a plane angularly located with respect to the axis of said spool so that a portion extends generally radially to the axis of said spool, (e) locking means releasably locking said crank arm with respect to said spool for rotating said crank arm and the spool therewith, (f) a hollow, cylindrical hand grip having an interior chamber telescopically mounted on the outer end of said crank arm and which is telescopically slideable with respect to the crank arm and is also pivotal on the outer end of said crank arm and which is rotatable with respect to said crank arm, (g) an elongate rod located within and extending coaxially within said hand grip and which rod has an elongate longitudinally extending guide slot therein, said hand grip being movable axially with respect to said rod from a position where it is almost completely disposed over and encircles and surrounds an outer end of said crank arm and is axially aligned with said crank arm to a position where it is moved axially outwardly with respect to said crank arm and is not encircling and telescopically disposed over said crank arm, (h) a guide pin moveable within said guide slot permitting relative movement between said rod and hand grip, and (i) means to control the limit of movement of said hand grip.

20. The winch of claim 19 further characterized in that said crank arm is pivotal to a plane where it is generally perpendicular to the axis of rotation of said spool after being moved axially outwardly with respect to said crank arm.

21. The winch of claim 20 further characterized in that said rod is extendable through an opening in said crank arm permitting said hand grip to be releasably locked to said crash arm in the angularly disposed position when said hand grip is pushed axially toward the crank arm and unlocked when the hand grip and the elongate rod are pulled perpendicularly axially relative to the axis of the crank arm so that said rod is removed from the opening.

* * * * *